United States Patent [19]

Zoleski et al.

[11] 4,428,850

[45] Jan. 31, 1984

[54] LOW FOAMING RAILWAY DIESEL ENGINE LUBRICATING OIL COMPOSITIONS

[75] Inventors: Benjamin H. Zoleski, Beacon; Frank J. Gaetani, Poughkeepsie, both of N.Y.

[73] Assignee: Texaco Inc., White Plains, N.Y.

[21] Appl. No.: 343,672

[22] Filed: Jan. 28, 1982

[51] Int. Cl.[3] ..... C10M 1/54

[52] U.S. Cl. ..... 252/42.7; 252/33.4; 252/56 R; 252/358

[58] Field of Search ..... 252/42.7, 56 R, 358, 252/33.4

[56] References Cited

U.S. PATENT DOCUMENTS

| | | | |
|---|---|---|---|
| 2,031,227 | 2/1936 | Pevere et al. | 252/56 R X |
| 2,528,466 | 10/1950 | Borsoff et al. | 252/42.7 X |
| 2,813,077 | 11/1957 | Rogers et al. | 252/42.7 X |
| 2,877,181 | 3/1959 | Dilworth et al. | 252/40.5 |
| 3,235,499 | 2/1966 | Waldmann | 252/56 R X |
| 3,429,820 | 2/1969 | Lyons et al. | 252/56 S X |
| 3,909,425 | 9/1975 | Crawford et al. | 252/33 X |
| 4,169,799 | 10/1979 | Sung et al. | 252/42.7 |
| 4,171,270 | 10/1979 | Sung et al. | 252/42.7 |

OTHER PUBLICATIONS

Ross, Sydney, "Chemical Antifoaming Agents", pp. 757–759, Chemical Industries, May 1949.

*Primary Examiner*—Andrew Metz

*Attorney, Agent, or Firm*—Carl G. Ries; Robert A. Kulason; Martin M. Glazer

[57] ABSTRACT

A low foaming lubricating oil composition comprising a mineral oil, an oil soluble detergent-like additive which increases the foaming tendency of the lubricating oil, and an effective amount of an estolide of a hydroxy fatty acid having 10 to 24 carbon atoms which reduces the foaming tendency of the lubricating oil composition. The lubricating oil achieves the low foaming tendency without added silicone polymers and has a silicon content of less than about 10 parts per million by weight. The preferred estolide is the estolide of 12-hydroxystearic acid.

18 Claims, No Drawings

LOW FOAMING RAILWAY DIESEL ENGINE LUBRICATING OIL COMPOSITIONS

BACKGROUND OF THE INVENTION

1. Field of the Invention

This invention relates to lubricating oil compositions having a low foaming tendency and a low concentration of silicon, and more particularly to the use of estolides as antifoaming agents.

2. The Prior Art

Oil based lubricants, hydraulic fluids, and the like, which are subject to stress during use contain additives similar to detergents which are used to prevent sludging, formation of gums, lacquer, resinous and other similar materials, on the surfaces of the devices which are lubricated or contacted by the oil. Deposition of such materials can lower the operating efficiency of the device using the lubricant. However, these detergent-like additives tend to cause the oil to foam during use. Such foaming, or air entrapment, is undesirable because the air occupies space between the surfaces to be lubricated thereby preventing proper lubrication of the surfaces by the oil. Further, the entrapment of air in the oil can cause an increase in the rate of oxidation. Such oxidation tends to form unwanted contaminants which further reduce the lubricating ability of the oil.

In many oils, foaming was controlled by the addition of a small quantity of a silicone fluid. The useful silicone fluids include silicone polymers, such as dimethyl silicones. However, many manufacturers of internal combustion engines and other devices which employ lubricating oils, not only specify the maximum amount of foaming permitted for the lubricating oil, but also specify the maximum concentration of silicon in the lubricating oil. Such silicon specifications arise from the fact that lubricating oils are regularly tested to determine the condition of the device using the oil. Since silicones are used as water conditioners in the cooling systems of many devices, the presence of relatively large quantities of silicon in the oil would give a false indication of a cooling system leak into the oil or would make such testing useless.

Presently preferred detergent-like additives, such as normal and overbased sulfurized calcium alkylphenolates disclosed in coassigned U.S. Pat. Nos. 4,169,799; 3,761,414; 3,549,534; and 3,474,035, and in coassigned U.S. patent application Ser. No. 78,346, filed Sept. 24, 1979, cause the lubricating oils to which these detergents are added to foam excessively during use. The quantity of the previously used silicone antifoaming agents required to reduce foaming to an acceptable level was found to be much higher than that allowed by many manufacturers of the devices using the lubricating oils.

Coassigned U.S. Pat. No. 3,909,425 discloses the use of an estolide of 12-hydroxystearic acid in a lubricating oil composition which contains many other ingredients, several of which are disclosed as being essential. None of the disclosed essential ingredients are used in the lubricating oil of the present invention. One of the ingredients disclosed as being essential is a zinc compound which would not be used in a lubricating oil composition intended for railway diesel engines because of the detrimental effect of zinc compounds on the silver components of the railway diesel engine. Further there is no disclosure of the use of the estolide of 12-hydroxystearic acid as an anti-foaming agent.

Coassigned U.S. Pat. No. 3,429,820 discloses a method for operating a power steering unit using a lubricating oil containing an estolide of 12-hydroxystearic acid. The estolide of 12-hydroxystearic acid is disclosed as imparting improved antisqueal properties to the power steering fluid. There is no disclosure that the estolide of 12-hydroxystearic acid has any antifoaming properties.

Coassigned U.S. Pat. No. 2,877,181 discloses the use of estolides, including 12-hydroxystearic acid, as stabilizers for anhydrous calcium fatty acid greases. There is no disclosure that the estolide of 12-hydroxystearic acid has any antifoaming properties.

SUMMARY OF THE INVENTION

A low foaming lubricating oil composition has been discovered which comprises a mineral oil, an oil soluble detergent-like additive which increases the foaming tendency of the lubricating oil, and an effective amount of an estolide of a hydroxy fatty acid containing about 10 to 24 carbon atoms which reduces the foaming tendency of the lubricating oil composition below a desired level. It has been found that such a lubricating oil composition has a far lower foaming tendency than a similar composition which does not contain the estolide of the hydroxy fatty acid. The preferred estolide comprises an estolide of 12-hydroxystearic acid. The preferred detergent-like additive comprises an overbased sulfurized calcium alkylphenolate. The lubricating oil can also contain other additives such as additional dispersants and pour depressors.

PREFERRED EMBODIMENT OF THE INVENTION

The preferred embodiment of the present invention comprises a low foaming lubricating oil composition useful in railway diesel engines and other types of internal combustion engines, which comprises a major amount of a mineral oil, a minor amount of an oil soluble detergent-like additive which increases the foaming tendency of the lubricating oil and comprises an overbased sulfurized calcium alkylphenolate, between about 0.1 and about 10 percent by weight of an estolide of 12-hydroxystearic acid, and possibly some other minor additives such as additional dispersants and pour depressors. Without the estolide, the lubricating oil composition has a high foaming tendency well above the 50 milliliters maximum set forth by the manufacturers of railway diesel engines, and as measured by the standard method ASTM D-892 Sequence II. However, with the added estolide the foaming tendency is reduced, an effective quantity of the estolide will readily reduce the foaming tendency to well below the desired 50 milliliters. The preferred composition contains no added silicon compounds, such as silicone polymers, and so is substantially free of silicone polymers and achieves a silicon content below the desired about 10 parts per million.

A preferred lubricating oil composition to which an estolide can be added to reduce foaming is disclosed in coassigned U.S. Pat. No. 4,169,799, which patent is hereby incorporated by reference. The lubricating oil composition broadly comprises a hydrocarbon base oil of lubricating viscosity, preferrably having an SUS viscosity at 38° C. (100° F.) of between about 50 and 250, an effective amount of a silver anti-wear mixture such as that disclosed in the patent, and as a detergent-like additive a sulfurized overbased calcium alkylphenolate whose composition and method of manufacture is similarly disclosed in the patent.

In another embodiment of the present invention, one which is preferred when supplying or shipping the lubricating oil composition in a concentrated form, the lubricating oil composition comprises a minor amount of a mineral oil, and a major amount of an estolide, preferably the estolide of 12 hydroxystearic acid. The useful concentration of the estolide in the lubricating oil composition of the present invention can range from about 0.1 to 95 percent by weight. Further, the concentration of the other additives found in the concentrated form of the lubricating oil composition is also much higher than in the diluted form of the lubricating oil composition (which is ultimately used in the internal combustion engine or other device) due to the decrease in the quantity of mineral oil present in the concentrated lubricating oil composition.

Another embodiment of the present invention comprises an additive mixture which is added to a mineral oil to form the low foaming lubricating oil composition, such an additive mixture is the most efficient form for shipping purposes since only the additives that are to be added to the mineral oil, which additives comprise a small part by weight of the lubricating oil composition, must be shipped. Generally, it has been found that it is cheaper to ship the additives and then mix these with mineral oil in a local distribution center, than to mix the additives with the mineral oil and ship the finished lubricating oil composition long distances. The preferred additive mixture useful for addition to a mineral oil to form the lubricating oil composition comprises an oil soluble detergent-like additive which increases the foaming tendency of a lubricating oil composition, an estolide of a hydroxy fatty acid having 10 to 24 carbon atoms which when added to the mineral oil reduces the foaming tendency of the lubricating oil composition below a desired level. Further, the additive mixture is substantially free of any additives which can detrimentally effect any silver components of a device using the lubricating oil composition, since any detrimental effects occurring to silver components, which are found in some diesel engines, will detrimentally effect the railway diesel engine. Also the additive mixture should be substantially free of silicone polymers, since the presence of these can raise the silicon content of the lubricating oil composition above that set forth by the manufacturers of railway diesel engines.

The preferred deteregent-like additive comprises an overbased sulfurized calcium alkylphenolate. The preferred estolide comprises an estolide of 12-hydroxystearic acid, prepared as described hereinafter. Further, the additive mixture can have various other additional additives as described hereinafter.

The preferred estolides of 12-hydroxystearic acid have the following general formula:

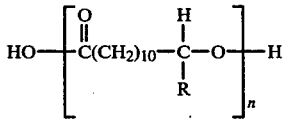

wherein R is an alkyl group of 6 carbon atoms, and n is an integer having a value of about 2 to 12.

The preferred estolides are formed by heat treatment of 12-hydroxystearic acid at temperatures of between about 90° C. and 175° C., preferably between about 150° C. and 175° C. The preferred estolides have a neutralization number below 40, a hydroxyl number below 25 and an average molecular weight of between about 600 and 3500. Extraction of the estolides from the reaction mixture can be accomplished by any one of several means including the use of aliphatic hydrocarbon solvents, such as hexane. The preferred estolides can be used as formed, without extraction, since the reaction by-products of the formation step do not generally adversely affect the properties of the lubricating oil.

Other estolides useful in the present invention are intermolecular esters and polyesters of hydroxy fatty acids having 10 to 24 carbon atoms. Such estolides have the following general formula:

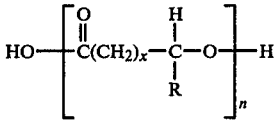

wherein R is an aliphatic hydrocarbon radical containing 1 to 21 carbon atoms, x is an integer having a value of 1 to about 21, and n is an integer having a value of 2 to about 12. The average molecular weight of these estolides is in the range of from about 500 to 3500. The preferred estolide concentration in the lubricating oil composition can be in the range of from about 0.1 to about 90 percent by weight, and preferably is in a range of from about 0.1 to about 10 percent by weight, and more preferably 0.25 percent to about 2 percent by weight.

The lubricating oil composition, as used in a device such as a diesel engine, is preferably of medium viscosity and can have a SUS viscosity at 38° C. (100° F.) of between about 50 and 250, and preferably between about 90 and 150. The mineral oil employed in the low foaming lubricating oil composition, or to which the additive mixture can be added, is derived from petroleum and is a hydrocarbon mineral oil of lubricating viscosity. Generally the mineral oil can be naphthenic, paraffinic or mixed naphthenic and paraffinic, and preferably comprises between about 80 and 95 percent of the lubricating oil composition. The paraffinic base oil preferably comprises from about 40 to about 60 percent by weight of the lubricating oil composition. The naphthenic base oil preferably comprises from about 30 to about 50 percent by weight of the low foaming lubricating oil composition. In the concentrate form of the lubricating oil composition, the mineral oil, of course, comprises a much lower percentage of the lubricating oil composition.

The preferred oil soluble detergent-like additive which increases the foaming tendency of the lubricating oil comprises an overbased alkaline earth metal sulfonate, with an overbased sulfurized calcium alkylphenolate being most preferred. The properties and methods of manufacturing the detergent-like additives are disclosed in the previously cited coassigned U.S. patents and patent applications. The concentration of the overbased sulfurized calcium alkylphenolate in the lubricating oil composition can vary from 0.1 to about 90 percent by weight (the higher weight percent when present in the lubricating oil concentrate), preferably from 0.1 is about 10 percent by weight and more preferably from about 3 to about 8 percent by weight.

Overbased alkaline earth metal sulfonate detergent-like additives are preferred, since such additives have a high degree of alkalinity. A total base number (TBN) of at least 10 is particularly desirable in that such additives prevent corrosion by oil-soluble acids formed by oxidation of the lubricating oil composition at the high temperature existing under normal conditions in the engine near the combustion chamber, and acids formed from the by-products of the combustion of the engine fuel. The total base number is defined as the quantity of acid, expressed in terms of the equivalent number of milligrams of potassium hydroxide that is required to neutralize all basic constituents present in one gram of a given sample. The method of evaluation is that defined as ASTM Method D664.

The low foaming lubricating oil composition, as well as the additive mixture, can also include minor quantities of several other additives such as supplementary dispersants, pour depressors, antioxidants, silver corrosion inhibitors, silver friction modifiers, viscosity index improvers, oleagenous agents, and minor quantities of various other antifoaming agents such as silicone polymers. However, the addition of any silicone polymers should be limited to maintain the silicon content of the lubricating oil composition below the permissible limit for the lubricating oil composition. For railway diesel lubricating oil compositions the limit is presently about 10 parts per million. The specific additives used in the lubricating oil composition and their concentration depend on the particular use to which the lubricating oil is to be put.

A supplementary dispersant which can be useful in the present invention comprises an alkenyl succinimide derivative of alkylene polyamines having 50 to 200 carbon atoms and described in U.S. Pat. Nos. 3,172,892 and 3,210,383. This supplementary dispersant appears to compliment the overbased sulfurized calcium alkylphenolate, to enhance the detergency, thermal stability and resistance to undesired oxidation of the lubricating oil composition. The succinimide dispersant can be used in the lubricating oil composition in a concentration of between about 0.01 to 90 percent (the higher percent when present in the lubricating oil concentrate), preferably from about 0.01 to about 15 weight percent and more preferably from about 0.03 to 5 weight percent. Other supplementary dispersants are described in U.S. Pat. Nos. 3,272,744; 3,087,956; and 3,123,630.

Between about 0.01 and 10 percent (the higher percent in the concentrate), preferably from about 0.01 to about 1 percent by weight of a pour depressor is included in the lubricating oil composition. Many useful pour depressor are well known in the art. Between about 0.5 and 90 weight percent (the higher percent in the concentrate), preferably from about 0.5 to about 10 percent by weight of a silver friction modifier is also included in the lubricating oil composition. Useful silver friction modifiers are well known.

The preferred lubricating oil composition, as well as the preferred additive mixture, is substantially free of additives which can detrimentally affect silver or silver-plated components because such additives, such as zinc compounds, are not generally used in lubricating oil compositions intended for railway diesel engines. This is because many railway diesel engines contain silver-plated parts such as silver-plated piston pin insert bearings, which would be detrimentally affected by such additives, this in turn would detrimentally affect the performance of the diesel engines.

The invention will be better understood from the following examples which are meant not to limit, but to illustrate the advantages of the addition of the estolides to the lubricating oil composition.

EXAMPLE 1

A railway type diesel lubricating oil composition was prepared by combining about 55 percent by weight of paraffinic mineral oils, and about 37 percent by weight of a naphthenic mineral oil, with about 5 percent by weight of an overbased sulfurized calcium alkylphenolate, about 2.9 percent weight by of a succinimide dispersant, about 0.05 by percent weight of a pour depressor, and about 0.05 percent weight of a chlorinated paraffinic type mineral oil which acts as a silver friction modifier. A foaming test, according to the method of ASTM D-892 Sequence II, was formed with the lubricating oil composition. The oil produced about 140 milliliters of foam. The silicon content of the oil was about 3 parts per million. The 140 milliliters of foam were beyond the maximum acceptable limit of 50 milliliters set by a major manufacturer of railway diesel engines for oil to be used in such engines.

ASTM D-892 Sequence II is a standard method of determining the foaming characteristics of lubricating oils. Briefly, the method comprises pouring a portion of the lubricating oil to be tested into a clean 1000 milliliter cylinder until the liquid level is at the 180 milliliter mark. The cylinder is immersed to at least the 900 milliliter mark in a bath maintained at a temperature of about 93.5° C.±0.5° C. When the oil has reached a temperature of about 93±1° C., a clean diffusion stone and air inlet tube are inserted into the oil. The stone is permitted to soak for about 5 minutes and then air is passed into the stone through the air inlet tube at the rate of about 94±5 milliliters per minute. The air is forced through the stone for about 5 minutes±3 seconds. At the end of the 5 minute period the air flow is shut off and the volume of foam is recorded. This volume of foam is the one referred to herein. The total air volume which has passed through the system should be about 470±25 milliliters.

EXAMPLE 2

To the lubricating oil composition formed in Example 1, about 300 parts per million of a silicone polymer was added. After foaming the oil as per ASTM D-892 Sequence II, about 20 milliliters of foam were observed. However, the silicon content of the oil was about 13 parts per million, which was well above the 10 parts per million permitted.

EXAMPLE 3

To the lubricating oil composition formed in Example 1, about 0.5 percent by weight of the estolide of 12-hydroxystearic acid was added. The estolide was formed by heating 12-hydroxystearic acid at a temperature of between about 150° and 175° C. until the neutralization number of the mixture was reduced below about 40, and the hydroxyl number was reduced below about 25. The mixture of 12-hydroxystearic acid which was heated to form the estolide, initially contained about 88 percent by weight 12-hydroxystearic acid and about 12 percent by weight other stearic acids. The estolide mixture produced by heating, without extraction, was used as the additive.

A foaming test was conducted, as in Example 1, and the quantity of foam observed was only about 30 milliliters. This is below the maximum allowable level of 50 milliliters.

EXAMPLE 4

To the lubricating oil composition formed in Example 1, about 0.75 percent by weight of the estolide of 12-hydroxystearic acid, as formed in Example 3, was added. After conducting a foaming test as in Example 1, only about 20 milliliters of foam were observed. This is below the maximum allowable level of 50 millilters.

EXAMPLE 5

To the lubricating oil composition formed in Example 1, about 1 percent by weight of the estolide of 12-hydroxystearic acid, as formed in Example 3, was added. After the foaming test, as in Example 1, only about 10 milliliters of foam were observed. This is well below the 50 milliliter limit permitted for diesel lubricating oil compositions.

In Examples 3 through 5 no silicone polymers were added to reduce the foaming tendency of the oil. This kept the silicon content of the lubricating oil composition at about 3 parts per million by weight. This is well below the 10 parts per million by weight maximum specified for a railway diesel engine type oil by a major manufacturer of railway diesel engines.

EXAMPLE 6

A railway type diesel lubricating oil composition was prepared by combining about 50.45 percent by weight of paraffinic mineral oils, and about 40 percent by weight of naphthenic mineral oils, with about 5.5 weight percent of an overbased calcium sulfurized alkylphenolate having a different overbasing ratio than the alkylphenolate used in Example 1, about 4 weight percent of a succinimide dispersant, and about 0.05 weight percent of a pour depressor different than that used in Example 1. The foaming test was performed as in Example 1, and about 800 milliliters of foam were observed, well above the 50 milliliters limit.

EXAMPLE 7

When 150 parts per million of a silicone polymer were added to the lubricating oil composition of Example 6, the observed foaming dropped to about 600 milliliters, still above the limit, and 16.1 parts per million of silicon were observed in the oil.

EXAMPLE 8

When 350 parts per million of a silicone polymer were added to the lubricating oil of Example 6, the observed foaming was reduced to about 40 milliliters, however, the silicon content jumped up to about 89 parts per million, well above the silicon limit of 10 parts per million.

EXAMPLE 9

The addition of about 1 percent by weight of the estolide of 12-hydroxystearic acid, to the mineral oil composition of Example 6 reduces the foaming of the oil of Example 6 below the maximum of 50 milliliters.

From the above examples it can be seen that the addition of the estolide of 12-hydroxystearic acid to the lubricating oil compositions significantly reduces the foaming tendency of railway diesel type lubricating oil compositions without increasing the silicon content of the compositions, and without the use of silicon containing additives which were previously thought necessary to reduce foaming.

The above examples are not meant to limit the invention in any way which invention is set forth in the following claims.

What is claimed is:

1. In a railway diesel engine lubricant composition comprising a major amount of a mineral lubricating oil and, in an amount which tends to increase foaming, a metal detergent additive selected from the group consisting of overbased sulfurized calcium alkylphenolates and overbased alkaline earth metal sulfonates and which composition has a silicon content of less than about 10 parts per million by weight, the improvement comprising the composition containing in an amount to reduce foaming of an estolide of a hydroxy fatty acid having 10 to 24 carbon atoms.

2. The lubricant composition of claim 1 wherein said estolide comprises an estolide of 12-hydroxystearic acid.

3. The lubricant composition of claim 2 wherein said estolide is prepared by heating 12-hydroxystearic acid at a temperature of between about 90° C. and 175° C.

4. The lubricant composition of claim 1 wherein said mineral oil comprises a mixture of paraffinic and naphthenic mineral oils.

5. The lubricant composition of claim 1 wherein said mineral oil comprises between about 40 and 60 percent by weight of a paraffinic mineral oil and between about 30 and 50 percent by weight of a naphthenic mineral oil, said metal detergent additive comprises between about 0.1 and 10 percent by weight of an overbased sulfurized calcium alkylphenolate, and said estolide comprises between about 0.1 and 10 percent by weight of the estolide of 12-hydroxystearic acid.

6. The lubricant composition of claim 2 wherein said estolide of 12-hydroxystearic acid has a molecular weight of between about 600 and 3500.

7. In a railway diesel engine lubricant composition comprising a major amount of a mineral lubricating oil; in an amount which tends to increase foaming, a metal detergent additive selected from the group consisting of overbased sulfurized calcium alkylphenolates and overbased alkaline earth metal sulfonates; and at least one additive selected from the group consisting of a supplementary dispersant, a pour depressor and a silver friction modifier, and which composition has a silicon content of less than about 10 parts per million by weight, the improvement comprising the composition containing in an amount to reduce foaming of an estolide of a hydroxy fatty acid having 10 to 24 carbon atoms.

8. The lubricant composition of claim 7 wherein said estolide comprises an estolide of 12-hydroxystearic acid.

9. The lubricant composition of claim 8 wherein said estolide is prepared by heating 12-hydroxystearic acid at a temperature of between about 90° C. and 175° C.

10. The lubricant composition of claim 8 wherein said estolide of 12-hydroxystearic acid has a molecular weight of between about 600 and 3500.

11. The lubricant composition of claim 7 wherein said estolide comprises from about 0.1 to about 10 percent by weight of said lubricating oil composition.

12. The lubricant composition of claim 7 wherein said mineral oil comprises a mixture of paraffinic and naphthenic mineral oils.

13. The lubricant composition of claim 7 wherein said mineral oil comprises between about 40 and 60 percent by weight of a paraffinic mineral oil and between about 30 and 50 percent by weight of a naphthenic mineral oil, said metal detergent additive comprising between about 0.1 and 10 percent by weight of an overbased sulfurized calcium alkenylphenolate, said estolide comprises between about 0.1 and 10 percent by weight of the estolide of 12-hydroxystearic acid; and wherein said lubricant composition further comprises between about 0.01 and 15 percent by weight of a succinimide dispersant, between about 0.01 and 1 percent by weight of a pour depressor, and between about 0.01 and 10 percent by weight of a silver friction modifier.

14. In a railway diesel engine lubricant concentrate composition comprising a minor amount of a mineral lubricating oil; in an amount which tends to increase foaming, a metal detergent additive selected from the group consisting of overbased sulfurized calcium alkylphenolates and overbased alkaline earth metal sulfonates; and at least one additive selected from the group consisting of a supplementary dispersant, a pour depressor and a silver friction modifier, and which composition has a silicon content of less than about 10 parts per million by weight, the improvement comprising the composition containing in an amount to reduce foaming of an estolide of a hydroxy fatty acid having 10 to 24 carbon atoms.

15. The lubricant concentrate of claim 14 wherein said estolide comprises an estolide of 12-hydroxystearic acid.

16. The lubricant concentrate of claim 15 wherein said estolide is prepared by heating 12-hydroxystearic acid at a temperature of between about 90° C. and 175° C.

17. The lubricant concentrate of claim 15 wherein said estolide of 12-hydroxystearic acid has a molecular weight of between about 600 and 3500.

18. The lubricant composition of claim 1 wherein said estolide comprises from about 0.1 to about 10 percent by weight of said lubricating oil composition.

* * * * *